US009429891B2

(12) United States Patent
Nanno et al.

(10) Patent No.: US 9,429,891 B2
(45) **Date of Patent: *Aug. 30, 2016**

(54) FIXING DEVICE AND IMAGE FORMING APPARATUS

(71) Applicant: RICOH COMPANY, LTD., Ohta-ku (JP)

(72) Inventors: Shigeo Nanno, Kyoto (JP); Yutaka Naitoh, Hyogo (JP); Minoru Toyoda, Hyogo (JP); Tomohiko Fujii, Hyogo (JP); Hitoshi Fujiwara, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/712,439

(22) Filed: May 14, 2015

(65) Prior Publication Data

US 2015/0248091 A1 Sep. 3, 2015

Related U.S. Application Data

(63) Continuation of application No. 14/040,866, filed on Sep. 30, 2013, now Pat. No. 9,063,486.

(30) Foreign Application Priority Data

Oct. 23, 2012 (JP) ..... 2012-233990

(51) Int. Cl.
*G03G 15/20* (2006.01)

(52) U.S. Cl.
CPC ..... *G03G 15/2085* (2013.01); *G03G 15/2053* (2013.01); *G03G 2215/2035* (2013.01)

(58) Field of Classification Search
USPC ..... 399/107, 110, 111, 122, 320, 328, 329; 219/216, 619
See application file for complete search history.

(56) References Cited

U.S. PATENT DOCUMENTS 8,472,855 B2 6/2013 Shinshi et al.
8,588,670 B2 11/2013 Shimokawa et al.

(Continued)

FOREIGN PATENT DOCUMENTS

JP 2010-096782 4/2010
JP 2010-224082 10/2010

(Continued)

OTHER PUBLICATIONS

JP Office Action issued on Jun. 21, 2016 for Japanese Patent Application No. 2012-233990.

*Primary Examiner* — Hoan Tran
(74) *Attorney, Agent, or Firm* — Oblon, McClelland, Maier & Neustadt, L.L.P

(57) ABSTRACT

A fixing device includes a heat conductor disposed opposite an inner circumferential surface of an endless belt to heat the endless belt. A nip formation pad is disposed opposite the inner circumferential surface of the endless belt and presses the endless belt against a pressing rotary body to form a fixing nip between the endless belt and the pressing rotary body through which a recording medium bearing a toner image is conveyed. A support is disposed opposite an inner circumferential surface of the heat conductor and contacts an abutment face of the nip formation pad to support the nip formation pad against pressure from the pressing rotary body. A heat insulator is interposed between the heater and the nip formation pad and the support to shield the nip formation pad and the support from the heater.

8 Claims, 8 Drawing Sheets

(56) References Cited

U.S. PATENT DOCUMENTS

| | | | | |
|---|---|---|---|---|
| 9,063,486 | B2 * | 6/2015 | Nanno | G03G 15/2053 |
| 2008/0056783 | A1 | 3/2008 | Yamamoto et al. | |
| 2009/0010680 | A1 | 1/2009 | Nanno | |
| 2009/0060572 | A1 | 3/2009 | Naitoh et al. | |
| 2009/0074440 | A1 | 3/2009 | Nanno et al. | |
| 2009/0092423 | A1 * | 4/2009 | Shin | G03G 15/2064 399/329 |
| 2009/0110449 | A1 | 4/2009 | Saito et al. | |
| 2009/0129836 | A1 | 5/2009 | Sakaya et al. | |
| 2010/0034548 | A1 | 2/2010 | Naitoh et al. | |
| 2010/0092220 | A1 | 4/2010 | Hasegawa et al. | |
| 2010/0232848 | A1 | 9/2010 | Naitoh | |
| 2011/0008082 | A1 | 1/2011 | Nanno | |
| 2011/0026944 | A1 | 2/2011 | Naitoh | |
| 2011/0058864 | A1 | 3/2011 | Shinshi et al. | |
| 2011/0142495 | A1 | 6/2011 | Nanno | |
| 2011/0200370 | A1 * | 8/2011 | Ikebuchi | G03G 15/2064 399/329 |
| 2011/0274453 | A1 * | 11/2011 | Shimokawa | G03G 15/2064 399/45 |
| 2012/0020681 | A1 | 1/2012 | Naitoh et al. | |
| 2012/0177422 | A1 | 7/2012 | Nanno et al. | |
| 2012/0275834 | A1 | 11/2012 | Naitoh et al. | |
| 2013/0064586 | A1 | 3/2013 | Adachi et al. | |

FOREIGN PATENT DOCUMENTS

| | | |
|---|---|---|
| JP | 2011-022430 A | 2/2011 |
| JP | 2011-059365 | 3/2011 |
| JP | 2012-123313 A | 6/2012 |

* cited by examiner

FIXING DEVICE AND IMAGE FORMING APPARATUS

CROSS-REFERENCE TO RELATED APPLICATIONS

This application is a continuation application of U.S. application Ser. No. 14/040,866, filed Sep. 30, 2013, and is based upon and claims priority under 35 U.S.C. §119 to Japanese Patent Application No. 2012-233990, filed on Oct. 23, 2012, in the Japanese Patent Office, and the entire contents of each of the above are incorporated herein by reference.

BACKGROUND

1. Technical Field

Exemplary aspects of the present invention relate to a fixing device and an image forming apparatus, and more particularly, to a fixing device for fixing an image on a recording medium and an image forming apparatus incorporating the fixing device.

2. Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include an endless belt heated by a heater and a pressing roller pressed against the endless belt to form a fixing nip therebetween through which a recording medium bearing a toner image is conveyed. As the recording medium is conveyed through the fixing nip, the endless belt and the pressing roller apply heat and pressure to the recording medium, melting and fixing the toner image on the recording medium.

Since the endless belt has a decreased heat capacity, it is heated by the heater quickly, shortening a warm-up time taken to heat the endless belt to a predetermined fixing temperature at which the toner image is fixed on the recording medium. For example, a metal heat conductor may be disposed opposite an inner circumferential surface of the endless belt. As the heater situated inside the substantially tubular, heat conductor heats the heat conductor, the heat conductor in turn heats the endless belt. A nip formation pad disposed opposite the inner circumferential surface of the endless belt presses the endless belt against the pressing roller to form the fixing nip between the endless belt and the pressing roller. A heat insulator is interposed between the heater and the nip formation pad to shield the nip formation pad from the heater. Thus, the heat insulator facilitates heating of the heat conductor and enhances durability of the nip formation pad.

However, the heat insulator, if it has an increased heat capacity, may decrease an amount of heat conducted to the heat conductor, degrading heating of the heat conductor. As a result, it may take longer to warm up the endless belt to the predetermined fixing temperature, consuming an increased amount of energy.

SUMMARY

This specification describes below an improved fixing device. In one exemplary embodiment, the fixing device includes a flexible endless belt rotatable in a predetermined direction of rotation and a heat conductor disposed opposite an inner circumferential surface of the endless belt to heat the endless belt. A heater is disposed opposite an inner circumferential surface of the heat conductor to heat the heat conductor. A pressing rotary body is disposed opposite the endless belt. A nip formation pad is disposed opposite the inner circumferential surface of the endless belt and presses the endless belt against the pressing rotary body to form a fixing nip between the endless belt and the pressing rotary body through which a recording medium bearing a toner image is conveyed. The nip formation pad includes an abutment face. A support is disposed opposite the inner circumferential surface of the heat conductor and contacts the abutment face of the nip formation pad to support the nip formation pad against pressure from the pressing rotary body. A heat insulator is interposed between the heater and the nip formation pad and the support to shield the nip formation pad and the support from the heater.

This specification further describes an improved image forming apparatus. In one exemplary embodiment, the image forming apparatus includes the fixing device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
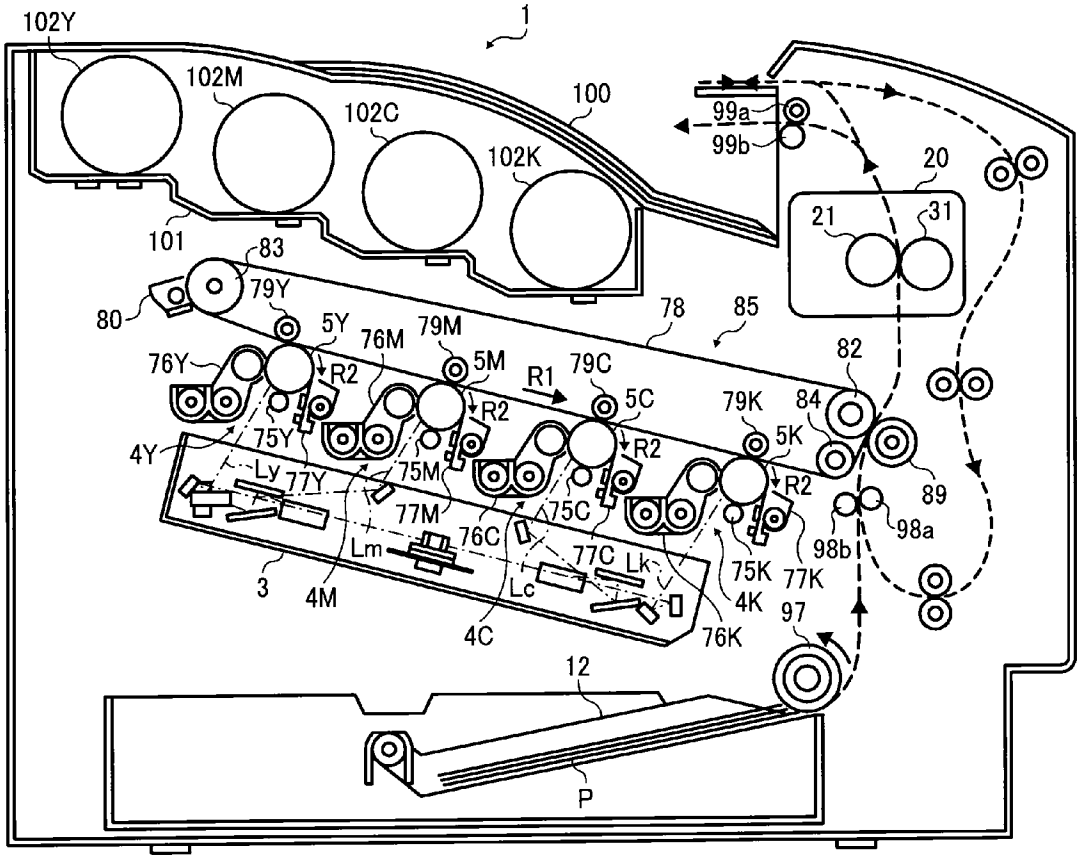
FIG. 1 is a schematic vertical sectional view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a tandem color printer that forms color and monochrome toner images on recording media by electrophotography.

As shown in FIG. 1, the image forming apparatus 1 includes image forming devices 4Y, 4M, 4C, and 4K that form yellow, magenta, cyan, and black toner images, respectively, a paper tray 12, a fixing device 20, an intermediate transfer unit 85, and a bottle holder 101.

The bottle holder 101 situated in an upper portion of the image forming apparatus 1 holds four toner bottles 102Y, 102M, 102C, and 102K detachably attached thereto and containing fresh yellow, magenta, cyan, and black toners, respectively.

Below the bottle holder 101 is the intermediate transfer unit 85 that includes an intermediate transfer belt 78, four primary transfer bias rollers 79Y, 79M, 79C, and 79K, an intermediate transfer belt cleaner 80, a secondary transfer backup roller 82, a cleaning backup roller 83, and a tension roller 84.

The intermediate transfer belt 78 of the intermediate transfer unit 85 is disposed opposite the image forming devices 4Y, 4M, 4C, and 4K aligned along a rotation direction R1 of the intermediate transfer belt 78. The image forming devices 4Y, 4M, 4C, and 4K include photoconductive drums 5Y, 5M, 5C, and 5K, chargers 75Y, 75M, 75C, and 75K, development devices 76Y, 76M, 76C, and 76K, cleaners 77Y, 77M, 77C, and 77K, and dischargers, respectively.

A description is provided of image forming processes performed on the photoconductive drums 5Y, 5M, 5C, and 5K.

A driver (e.g., a motor) drives and rotates the photoconductive drums 5Y, 5M, 5C, and 5K clockwise in FIG. 1 in a rotation direction R2. The image forming processes include a charging process, an exposure process, a development process, a primary transfer process, and a cleaning process.

In the charging process, the chargers 75Y, 75M, 75C, and 75K disposed opposite the photoconductive drums 5Y, 5M, 5C, and 5K uniformly charge an outer circumferential surface of the respective photoconductive drums 5Y, 5M, 5C, and 5K.

In the exposure process, an exposure device 3 situated below the photoconductive drums 5Y, 5M, 5C, and 5K emits laser beams Ly, Lm, Lc, and Lk onto the charged outer circumferential surface of the respective photoconductive drums 5Y, 5M, 5C, and 5K that scan and expose the outer circumferential surface of the respective photoconductive drums 5Y, 5M, 5C, and 5K according to yellow, magenta, cyan, and black image data sent from an external device such as a client computer, thus forming electrostatic latent images thereon.

In the development process, the development devices 76Y, 76M, 76C, and 76K disposed opposite the photoconductive drums 5Y, 5M, 5C, and 5K develop the electrostatic latent images formed on the photoconductive drums 5Y, 5M, 5C, and 5K with yellow, magenta, cyan, and black toners supplied from the toner bottles 102Y, 102M, 102C, and 102K into yellow, magenta, cyan, and black toner images, respectively.

The photoconductive drums 5Y, 5M, 5C, and 5K are disposed opposite the primary transfer bias rollers 79Y, 79M, 79C, and 79K via the intermediate transfer belt 78 to form primary transfer nips between the intermediate transfer belt 78 and the photoconductive drums 5Y, 5M, 5C, and 5K, respectively. In the primary transfer process, the primary transfer bias rollers 79Y, 79M, 79C, and 79K primarily transfer the yellow, magenta, cyan, and black toner images formed on the photoconductive drums 5Y, 5M, 5C, and 5K, respectively, onto the intermediate transfer belt 78. After the primary transfer process, a slight amount of residual toner failed to be transferred onto the intermediate transfer belt 78 remains on the photoconductive drums 5Y, 5M, 5C, and 5K.

To address this circumstance, in the cleaning process, a cleaning blade of the respective cleaners 77Y, 77M, 77C, and 77K disposed opposite the photoconductive drums 5Y, 5M, 5C, and 5K mechanically collects the residual toner from the photoconductive drums 5Y, 5M, 5C, and 5K. Finally, the discharger disposed opposite the respective photoconductive drums 5Y, 5M, 5C, and 5K eliminates residual potential from the photoconductive drums 5Y, 5M, 5C, and 5K.

A description is provided of the primary transfer process and a secondary transfer process performed on the intermediate transfer belt 78 after the image forming processes described above.

First, a description is given of the primary transfer process.

The intermediate transfer belt 78 is stretched taut across the secondary transfer backup roller 82, the cleaning backup roller 83, and the tension roller 84. The four primary transfer bias rollers 79Y, 79M, 79C, and 79K and the photoconductive drums 5Y, 5M, 5C, and 5K sandwich the intermediate transfer belt 78 to form the primary transfer nips between the photoconductive drums 5Y, 5M, 5C, and 5K and the intermediate transfer belt 78. A transfer bias having a polarity opposite a polarity of toner is applied to the primary transfer bias rollers 79Y, 79M, 79C, and 79K.

As the secondary transfer backup roller 82 drives and rotates the intermediate transfer belt 78 in the rotation direction R1, the yellow, magenta, cyan, and black toner images formed on the photoconductive drums 5Y, 5M, 5C, and 5K are primarily transferred successively onto the intermediate transfer belt 78 passing through the primary transfer nips formed between the intermediate transfer belt 78 and the primary transfer bias rollers 79Y, 79M, 79C, and 79K. Thus, the yellow, magenta, cyan, and black toner images are superimposed on the same position on the intermediate transfer belt 78, forming a color toner image on the intermediate transfer belt 78. Next, a description is given of the secondary transfer process performed on the intermediate transfer belt 78.

A secondary transfer roller 89 is disposed opposite the secondary transfer backup roller 82 via the intermediate transfer belt 78 to form a secondary transfer nip between the secondary transfer roller 89 and the intermediate transfer belt 78. As the color toner image formed on the intermediate transfer belt 78 reaches the secondary transfer nip, the color toner image is secondarily transferred onto a recording medium P conveyed through the secondary transfer nip. After the secondary transfer, the intermediate transfer belt cleaner 80 disposed opposite the intermediate transfer belt 78 collects residual toner failed to be transferred onto the recording medium P and therefore remaining on the intermediate transfer belt 78 therefrom.

The paper tray 12 situated in a lower portion of the image forming apparatus 1 loads a plurality of recording media P (e.g., transfer sheets).

A description is provided of conveyance of the recording medium P from the paper tray 12 to the secondary transfer nip.

As a feed roller 97 is driven and rotated counterclockwise in FIG. 1, an uppermost recording medium P of the plurality of recording media P placed on the paper tray 12 is conveyed to a roller nip formed between two registration rollers 98*a* and 98*b*. As the recording medium P comes into contact with the registration rollers 98*a* and 98*b*, the registration rollers 98*a* and 98*b* that interrupt their rotation halt the recording medium P at the roller nip formed between the registration rollers 98*a* and 98*b* temporarily. At a time when the color toner image formed on the intermediate transfer belt 78 reaches the secondary transfer nip, the registration rollers 98*a* and 98*b* resume their rotation to feed the recording medium P to the secondary transfer nip. As the recording medium P is conveyed through the secondary transfer nip, the color toner image formed on the intermediate transfer belt 78 is secondarily transferred onto the recording medium P.

Thereafter, the recording medium P bearing the color toner image is conveyed to the fixing device 20. As the recording medium P bearing the color toner image is conveyed between a fixing belt 21 and a pressing roller 31, the fixing belt 21 and the pressing roller 31 apply heat and pressure to the recording medium P, fixing the color toner image on the recording medium P. Thereafter, the recording medium P bearing the fixed color toner image is discharged by output rollers 99*a* and 99*b* and stacked on an outside of the image forming apparatus 1, that is, an output tray 100 disposed atop the image forming apparatus 1. Thus, a series of image forming processes performed by the image forming apparatus 1 is completed.

Figure 2:
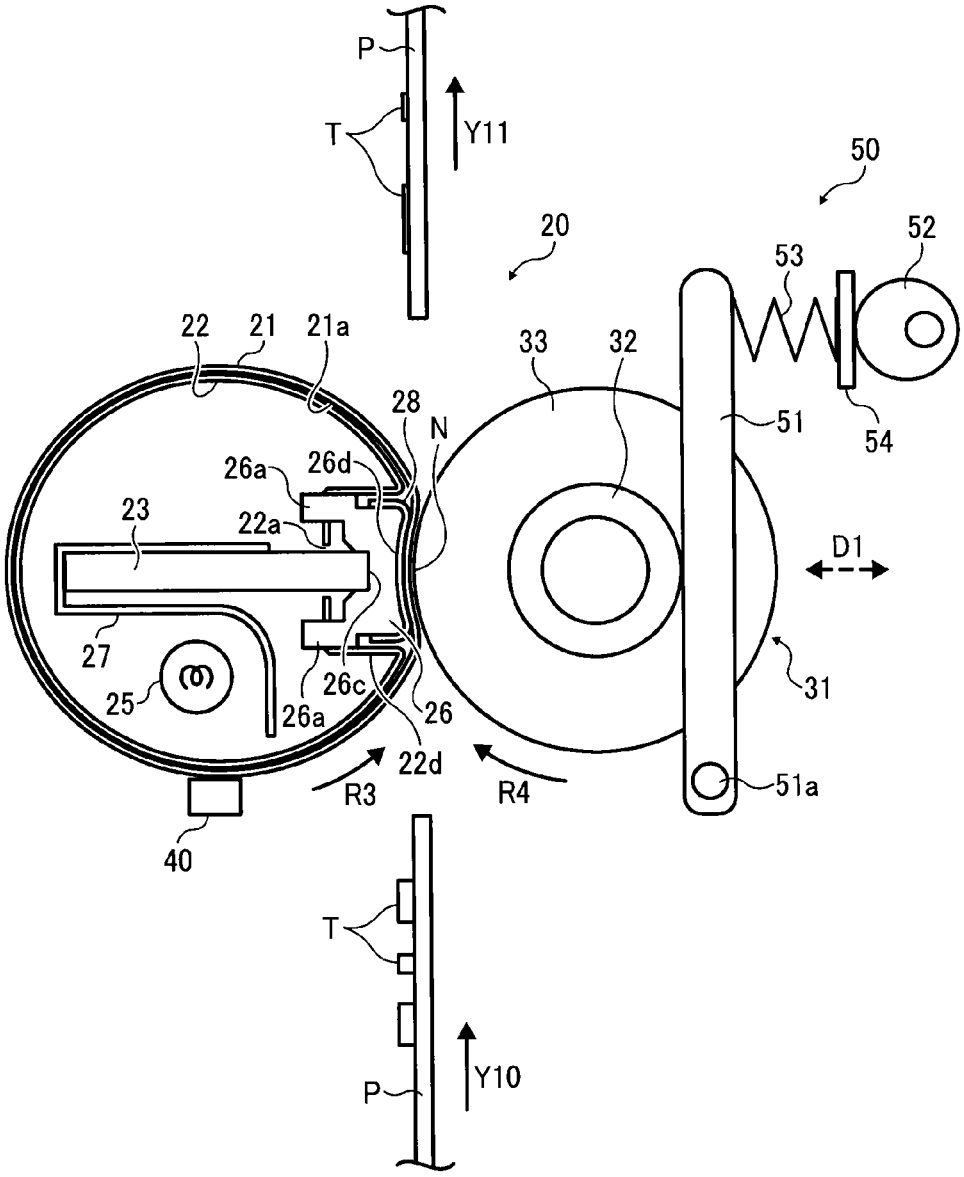
FIG. 2 is a vertical sectional view of a fixing device incorporated in the image forming apparatus shown in FIG. 1.
Figure 3:
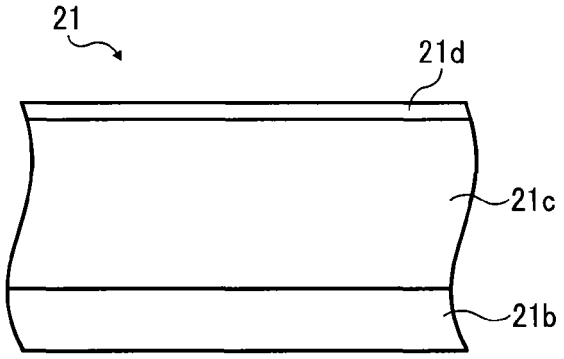
FIG. 3 is a partial vertical sectional view of a fixing belt incorporated in the fixing device shown in FIG. 2.
Figure 4:
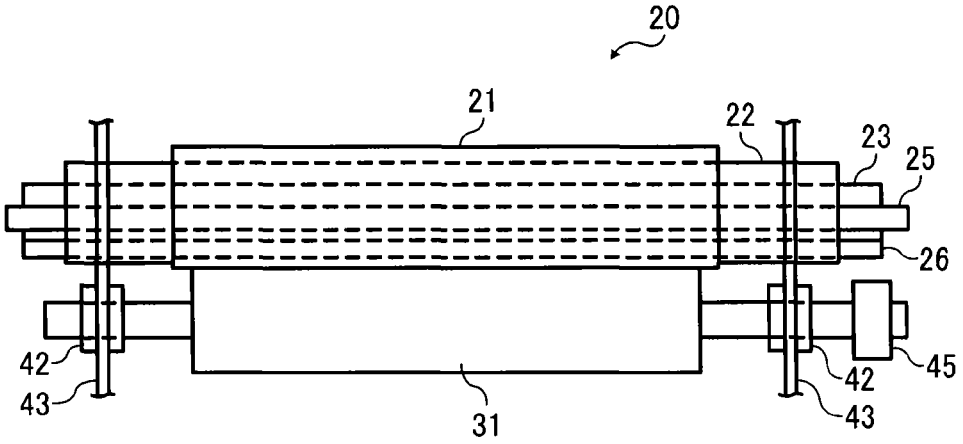
FIG. 4 is a side view of the fixing device shown in FIG. 2.

With reference to FIGS. 2 to 4, a description is provided of a configuration of the fixing device 20 incorporated in the image forming apparatus 1 described above.

FIG. 2 is a vertical sectional view of the fixing device 20. As shown in FIG. 2, the fixing device 20 (e.g., a fuser) includes the fixing belt 21 serving as an endless belt, a heat conductor 22, a support 23, a heater 25, a nip formation pad 26, a heat insulator 27, a low-friction sheet 28, the pressing roller 31 serving as a pressing rotary body, a temperature sensor 40, and a pressurization assembly 50.

A detailed description is now given of a construction of the fixing belt 21.

The fixing belt 21 is a thin, flexible endless belt rotatable counterclockwise in FIG. 2 in a rotation direction R3. For example, the endless, fixing belt 21 is formed in a seamless belt manufactured by combining both ends of a band. FIG. 3 is a partial vertical sectional view of the fixing belt 21. As shown in FIG. 3, the fixing belt 21, having a thickness of about 1 mm or smaller, is constructed of a base layer 21*b* constituting an inner circumferential surface 21*a*; an elastic layer 21*c* coating the base layer 21*b*; and a surface release layer 21*d* coating the elastic layer 21*c*. The base layer 21*b*, having a thickness in a range of from about 30 micrometers to about 100 micrometers, is made of metal such as nickel and stainless steel or resin such as polyimide. However, the configuration of the base layer 21*b* of the fixing belt 21 is not limited to the above. It is to be noted that the base layer 21*b* is made of a basic material. Since the metal heat conductor 22 is interposed between the heater 25 and the fixing belt 21, light emitted from the heater 25 does not irradiate the fixing belt 21 directly. Accordingly, the base layer 21*b* of the fixing belt 21 is not requested to be made of a material having relatively great heat resistance. Hence, the base layer 21*b* of the fixing belt 21 is made of resin manufactured at reduced costs.

The elastic layer 21*c*, having a thickness in a range of from about 100 micrometers to about 300 micrometers, is made of rubber such as silicone rubber, silicone rubber foam, and fluoro rubber. However, the configuration of the elastic layer 21*c* of the fixing belt 21 is not limited to the above. The elastic layer 21*c* absorbs slight surface asperities of the fixing belt 21 at a fixing nip N formed between the fixing belt 21 and the pressing roller 31 when the pressing roller 31 is pressed against the nip formation pad 26 via the fixing belt 21, facilitating even conduction of heat from the fixing belt 21 to a toner image T on a recording medium P passing through the fixing nip N. Accordingly, the elastic layer 21*c* suppresses formation of an orange peel image on the recording medium P. The orange peel image defines a faulty toner image having lots of slight surface asperities on a surface thereof.

The release layer 21*d*, having a thickness in a range of from about 10 micrometers to about 50 micrometers, is made of tetrafluoroethylene-perfluoroalkylvinylether copolymer (PFA), polytetrafluoroethylene (PTFE), polyimide, polyether imide, polyether sulfone (PES), or the like. However, the configuration of the release layer 21*d* of the fixing belt 21 is not limited to the above. The release layer 21*d* facilitates separation of the toner image T on the recording medium P from the fixing belt 21. A loop diameter of the fixing belt 21 is in a range of from about 15 mm to about 120 mm. According to this exemplary embodiment, the loop diameter of the fixing belt 21 is about 30 mm. However, the configuration of the fixing belt 21 is not limited to the above.

A detailed description is now given of a configuration of the nip formation pad 26.

The nip formation pad 26 is made of heat resistant resin such as liquid crystal polymer. As shown in FIG. 2, the nip formation pad 26 has an opposed face 26*d* disposed opposite the pressing roller 31 via the fixing belt 21 and is curved or concave with respect to the pressing roller 31 in accordance with the curvature of the pressing roller 31, that is, a curve of the pressing roller 31 at the fixing nip N. Accordingly, the curved opposed face 26*d* of the nip formation pad 26 directs the recording medium P discharged from the fixing nip N along the curve of the pressing roller 31, facilitating separation of the recording medium P bearing the fixed toner image T from the fixing belt 21 and preventing the recording medium P from adhering to the fixing belt 21.

FIG. 4 is a side view of the fixing device 20. As shown in FIG. 4, both lateral ends of the nip formation pad 26 in a longitudinal direction thereof parallel to an axial direction of the fixing belt 21 are mounted on and supported by side plates 43 of the fixing device 20, respectively. Since the nip formation pad 26 is mounted on the side plates 43, the nip formation pad 26 is immovable at least in a recording medium conveyance direction Y10. The low-friction sheet 28 interposed between the nip formation pad 26 and the fixing belt 21 reduces frictional resistance between the nip formation pad 26 and the fixing belt 21 sliding thereover. The low-friction sheet 28 is made of a material having a decreased friction coefficient and resistance against abrasion and heat such as porous fluoroplastic. As shown in FIG. 2, the low-friction sheet 28 is substantially U-shaped in cross-section.

A detailed description is now given of a configuration of the heat conductor 22.

As shown in FIG. 4, both lateral ends of the heat conductor 22 in a longitudinal direction thereof parallel to the axial direction of the fixing belt 21 are mounted on and supported by the side plates 43 of the fixing device 20, respectively. The heat conductor 22 is a pipe or a tube having a thickness of about 0.2 mm or less. However, the configuration of the heat conductor 22 is not limited to the above. For example, the heat conductor 22 is made of conductive metal such as aluminum, iron, and stainless steel.

The heat conductor 22 having the thickness of about 0.2 mm or less, as it is heated by the heater 25, heats the fixing belt 21 effectively. According to this exemplary embodiment, the heat conductor 22 has a thickness of about 0.1 mm and made of stainless steel. However, the configuration of the heat conductor 22 is not limited to the above. As shown in FIG. 2, the heat conductor 22 is in proximity to or in contact with the inner circumferential surface 21*a* of the fixing belt 21 at a position other than the fixing nip N. At the fixing nip N, the heat conductor 22 is bent to produce a recess 22*d* defining an opening 22*a*.

At ambient temperature, a clearance A greater than 0 mm and not greater than about 1 mm is provided between the fixing belt 21 and the heat conductor 22 at the position other than the fixing nip N. However, the size of the clearance A is not limited to the above. The clearance A decreases the area on the fixing belt 21 where the fixing belt 21 slides over the heat conductor 22 and thereby suppresses abrasion of the fixing belt 21. Simultaneously, since the heat conductor 22 is not isolated from the fixing belt 21 with an excessively great clearance therebetween, the heat conductor 22 heats the fixing belt 21 effectively. Additionally, since the heat conductor 22 is in proximity to the fixing belt 21, even if the flexible fixing belt 21 deforms, the heat conductor 22 supports the fixing belt 21, retaining the circular loop shape of the fixing belt 21 and thereby reducing deformation and resultant wear of the fixing belt 21. A lubricant, such as fluorine grease, is applied between the heat conductor 22 and the fixing belt 21 sliding thereover to reduce frictional resistance therebetween.

The heat conductor 22 is a thin metal plate. As the heat conductor 22 is heated by radiation heat from the heater 25 mounted on the side plates 43 of the fixing device 20, the heat conductor 22 in turn heats the fixing belt 21. That is, the heat conductor 22 is heated by the heater 25 directly. The fixing belt 21 is heated by the heater 25 indirectly through the heat conductor 22. The fixing belt 21 heats the toner image T on the recording medium P conveyed over the outer circumferential surface of the fixing belt 21.

The heater 25 is a halogen heater, a carbon heater, or the like. The temperature sensor 40 (e.g., a thermistor) disposed opposite the outer circumferential surface of the fixing belt 21 detects the temperature of the outer circumferential surface of the fixing belt 21. A controller (e.g., a processor), that is, a central processing unit (CPU) provided with a random-access memory (RAM) and a read-only memory (ROM), for example, operatively connected to the heater 25 and the temperature sensor 40 controls the heater 25 based on the temperature of the fixing belt 21 detected by the temperature sensor 40 so as to adjust the temperature of the fixing belt 21 to a desired fixing temperature to fix the toner image T on the recording medium P.

The heat conductor 22 having the configuration described above heats the fixing belt 21 over substantially the entire span of the fixing belt 21 in a circumferential direction thereof, not over a partial span of the fixing belt 21. Accordingly, even when the recording medium P is conveyed through the fixing nip N at high speed, the heat conductor 22 heats the fixing belt 21 sufficiently, minimizing faulty fixing that may arise due to a decreased temperature of the fixing belt 21 lower than the desired fixing temperature.

A detailed description is now given of a configuration of the support 23.

As shown in FIG. 2, the support 23 is stationarily situated inside the loop formed by the fixing belt 21 to support the nip formation pad 26 against pressure from the pressing roller 31. As shown in FIG. 4, both lateral ends of the support 23 in a longitudinal direction thereof parallel to the axial direction of the fixing belt 21 are mounted on and supported by the side plates 43 of the fixing device 20, respectively. The support 23 presses against the pressing roller 31 via the nip formation pad 26 and the fixing belt 21, supporting the nip formation pad 26 against pressure from the pressing roller 31 at the fixing nip N and thereby protecting the nip formation pad 26 from substantial deformation by pressure from the pressing roller 31. The support 23 is made of metal having a relatively great mechanical strength such as stainless steel and ferro-alloy that achieves the advantages of the support 23 described above to support the nip formation pad 26.

Conventionally, no heat insulator is interposed between the heater 25 and the nip formation pad 26. For example, if the heat insulator 27 is not provided inside the loop formed by the fixing belt 21, the heater 25 may heat the support 23 and the nip formation pad 26 as well as the heat conductor 22 and therefore may not heat the fixing belt 21 efficiently. Since the support 23 is mounted on and supported by the side plates 43 of the fixing device 20, the side plates 43 may draw heat from the support 23, resulting in inefficient heating of the fixing belt 21. Further, since the nonmetallic nip formation pad 26 includes a plurality of projections 26*a* projecting beyond the heat conductor 22 toward the heater 25, the nip formation pad 26 may be heated by the heater 25 directly, degrading its durability. To address this circumstance, the heat insulator 27 is disposed opposite the inner circumferential surface 21*a* of the fixing belt 21.

A detailed description is now given of a configuration of the heat insulator 27.

As shown in FIG. 2, the heat insulator 27 made of a single structural component is interposed between the heater 25 and the nip formation pad 26 and mounted on the support 23.

The heat insulator 27 is made of a material having an infrared reflectance not smaller than about 90 percent to prevent the heater 25 from heating the support 23 and the nip formation pad 26.

Figure 5:
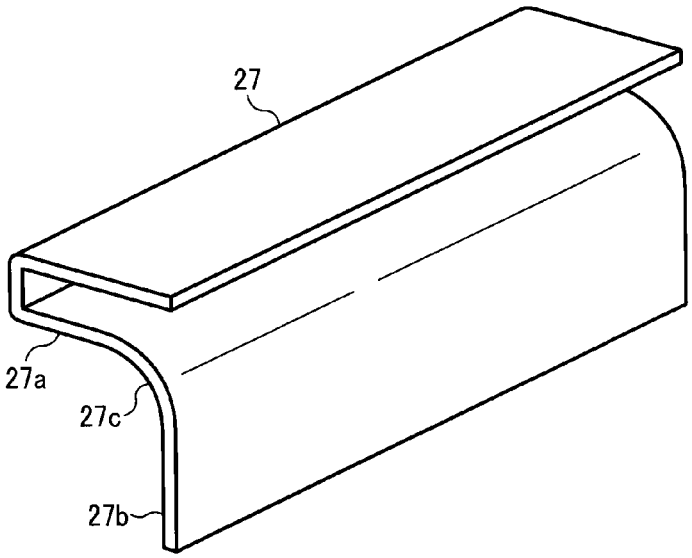
FIG. 5 is a perspective view of a heat insulator incorporated in the fixing device shown in FIG. 2.

FIG. 5 is a perspective view of the heat insulator 27. As shown in FIG. 5, the heat insulator 27 includes a first reflection face 27*a*, a second reflection face 27*b*, and a curved, third reflection face 27*c*, which are disposed opposite the heater 25. The curved, third reflection face 27*c* bridges the first reflection face 27*a* and the second reflection face 27*b*. The first reflection face 27*a*, the second reflection face 27*b*, and the curved, third reflection face 27*c* of the heat insulator 27 reflect light radiated from the heater 25 thereto toward the heat conductor 22, allowing the light to irradiate and heat the heat conductor 22 efficiently. The heat insulator 27 is made of high intensity aluminum having a thickness of about 0.5 mm. However, the configuration of the heat insulator 27 is not limited to the above.

A detailed description is now given of a construction of the pressing roller 31.

As shown in FIG. 2, the pressing roller 31 serves as a pressing rotary body contacting an outer circumferential surface of the fixing belt 21 at the fixing nip N. The pressing roller 31 having a diameter in a range of from about 30 mm to about 40 mm is constructed of a hollow metal core 32 and an elastic layer 33 coating the metal core 32. However, the construction of the pressing roller 31 is not limited to the above. The pressing roller 31 is pressed against the nip formation pad 26 via the fixing belt 21 to form the desired fixing nip N between the pressing roller 31 and the fixing belt 21.

The pressing roller 31 mounts a gear engaging a driving gear of a driver that drives and rotates the pressing roller 31 clockwise in FIG. 2 in a rotation direction R4. As shown in FIG. 4, both lateral ends of the pressing roller 31 in an axial direction thereof are rotatably mounted on the side plates 43 of the fixing device 20 through bearings 42, respectively. As shown in FIG. 2, a pressurization direction D1 in which the pressing roller 31 is pressed against the nip formation pad 26 is disposed opposite the support 23.

The elastic layer 33 is made of silicone rubber foam, silicone rubber, fluoro rubber, or the like. Optionally, a thin, surface release layer made of PFA, PTFE, or the like may coat the elastic layer 33. If the elastic layer 33 of the pressing roller 31 is made of sponge such as silicone rubber foam, the pressing roller 31 exerts reduced pressure to the nip formation pad 26 at the fixing nip N, reducing bending of the nip formation pad 26. The elastic layer 33 suppresses heat conduction from the fixing belt 21 to the pressing roller 31, improving heating efficiency of the fixing belt 21.

With reference to FIG. 2, a detailed description is now given of a construction of the pressurization assembly 50.

The pressurization assembly 50 brings the pressing roller 31 into contact with and isolation from the fixing belt 21. The pressurization assembly 50 is constructed of a pressing lever 51, an eccentric cam 52, a spring 53, and a spring support plate 54.

The pressing lever 51 is pivotable about a shaft 51*a* attached to one end of the pressing lever 51 in a longitudinal direction thereof and mounted on the side plate 43 of the fixing device 20. A center of the pressing lever 51 in the longitudinal direction thereof contacts the bearing 42 depicted in FIG. 4 that bears the pressing roller 31 and is movably supported by an elongate hole produced in the side plate 43.

The spring 53 is anchored to another end of the pressing lever 51 in the longitudinal direction thereof and the spring support plate 54. The spring support plate 54 contacts the eccentric cam 52. The eccentric cam 52 is rotatable by a driving motor.

During a fixing job, as the driving motor rotates the eccentric cam 52, the pressing lever 51 pivots about the shaft 51*a*. When the eccentric cam 52 is at a pressurization position shown in FIG. 2, the pressing lever 51 presses the pressing roller 31 against the fixing belt 21, forming the desired fixing nip N therebetween. Conversely, while a fixing job is not performed, for example, while the recording medium P is jammed between the pressing roller 31 and the fixing belt 21, the eccentric cam 52 rotates a half-turn from the pressurization position shown in FIG. 2, causing the pressing lever 51 to isolate the pressing roller 31 from the fixing belt 21 or to press the pressing roller 31 against the fixing belt 21 with decreased pressure therebetween.

Figure 6:
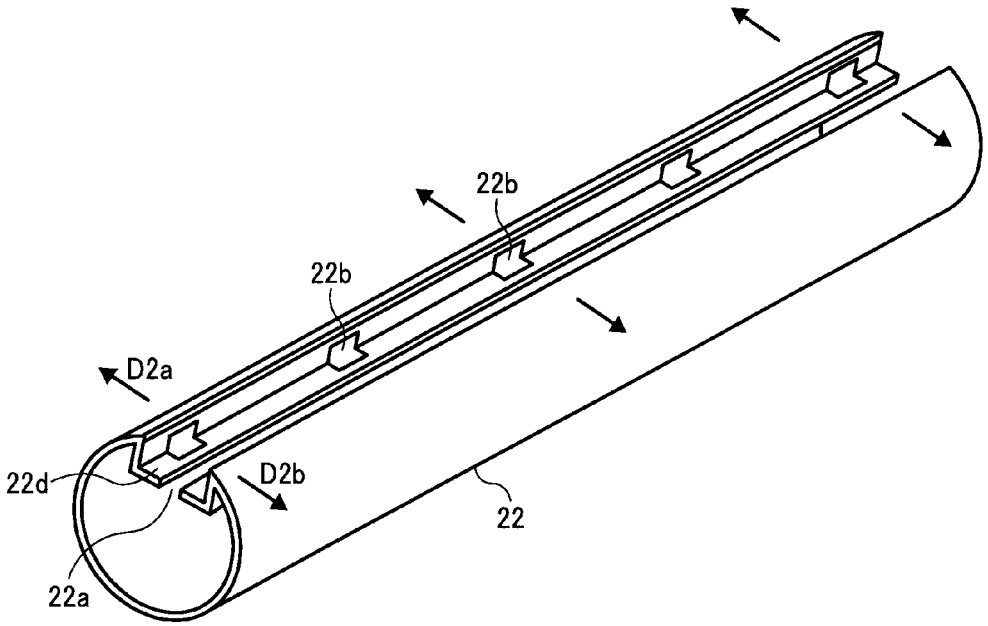
FIG. 6 is a perspective view of a heat conductor incorporated in the fixing device shown in FIG. 2.

With reference to FIG. 6, a description is provided of manufacturing and installation of the heat conductor 22.

FIG. 6 is a perspective view of the heat conductor 22. The heat conductor 22 is formed into a pipe or a tube by bending a tractable, stainless steel plate having a thickness of about 0.1 mm. However, manufacturing of the heat conductor 22 is not limited to the above. As the stainless steel plate is bent into a substantial pipe or tube to create the opening 22*a* as shown in FIG. 6, the stainless steel plate may widen the opening 22*a* in directions D2*a* and D2*b* by its springback. To address this circumstance, the heat conductor 22 includes the recess 22*d* defining the opening 22*a* and produced with a plurality of through-holes 22*b*. As the projections 26*a* of the nip formation pad 26 depicted in FIG. 2 are inserted into the through-holes 22*b* of the heat conductor 22, the nip formation pad 26 is attached to the heat conductor 22, restricting springback of the heat conductor 22 and forming the heat conductor 22 into a desired shape.

Figure 7A:
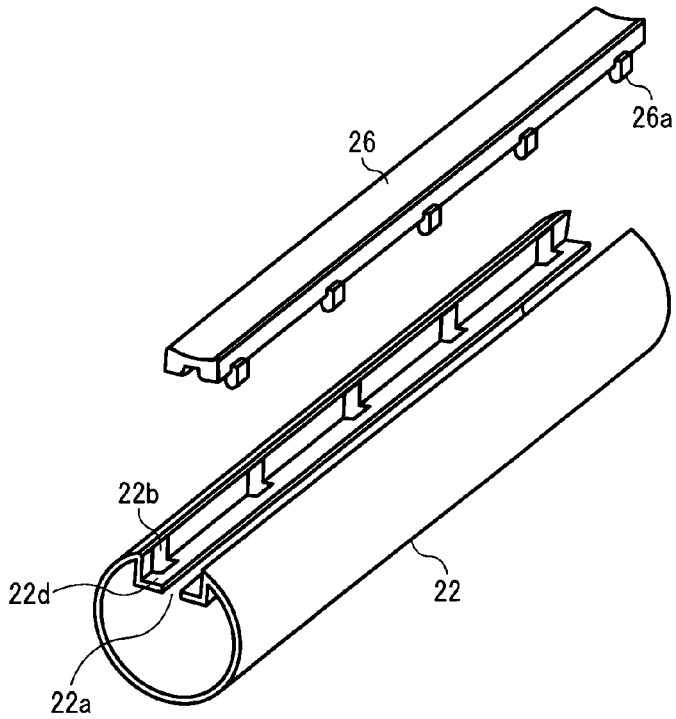
FIG. 7A is a perspective view of a nip formation pad incorporated in the fixing device shown in FIG. 2 before being attached to the heat conductor.
Figure 7B:
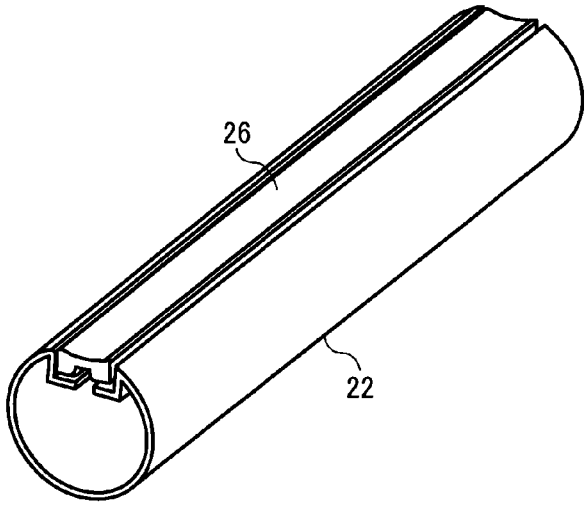
FIG. 7B is a perspective view of the nip formation pad shown in FIG. 7A attached to the heat conductor.
Figure 8:
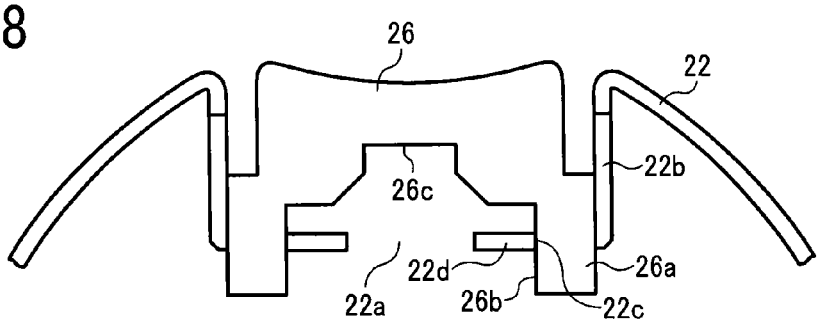
FIG. 8 is a vertical sectional view of the nip formation pad and the heat conductor shown in FIG. 7B.

With reference to FIGS. 7A, 7B, and 8, a description is provided of assembly of the heat conductor 22 and the nip formation pad 26.

FIG. 7A is a perspective view of the nip formation pad 26 before being attached to the heat conductor 22. FIG. 7B is a perspective view of the nip formation pad 26 attached to the heat conductor 22. FIG. 8 is a vertical sectional view of the nip formation pad 26 attached to the heat conductor 22.

As shown in FIG. 7A, the plurality of through-holes 22*b* is aligned in the recess 22*d* of the heat conductor 22 in the longitudinal direction of the nip formation pad 26. Similarly, the plurality of projections 26*a* of the nip formation pad 26 is aligned in the longitudinal direction of the nip formation pad 26 such that the plurality of projections 26*a* corresponds to the plurality of through-holes 22*b*. As the nip formation pad 26 is embedded in the recess 22*d* of the heat conductor 22, the projections 26*a* of the nip formation pad 26 are inserted into the through-holes 22*b* of the heat conductor 22. Thus, the nip formation pad 26 is attached to the heat conductor 22 as shown in FIG. 7B.

As shown in FIG. 8, a restriction face 26*b* of the projection 26*a* of the nip formation pad 26 contacts a restriction face 22*c* of the recess 22*d* of the heat conductor 22 that defines the through-hole 22*b*, preventing the opening 22*a* from being widened by springback of the heat conductor 22. The restriction face 26*b* of the respective projections 26*a* of the nip formation pad 26 contacts the restriction face 22*c* defining the respective through-holes 22*b* of the heat conductor 22. That is, the restriction face 26*b* of the nip formation pad 26 contacts the restriction face 22*c* of the heat conductor 22 at a plurality of positions in the longitudinal direction of the nip formation pad 26 and the heat conductor 22, preventing partial deformation and widening of the heat conductor 22 throughout the longitudinal direction thereof. Since the heat conductor 22 neither deforms nor widens partially in the longitudinal direction thereof, the heat conductor 22 does not come in contact with the fixing belt 21 in an increased area, suppressing abrasion of the fixing belt 21.

As shown in FIGS. 2 and 8, the nip formation pad 26 includes an abutment face 26*c* abutting the support 23 to receive pressure from the pressing roller 31 throughout the long width of the nip formation pad 26 in the longitudinal direction thereof. If the abutment face 26*c* of the nip formation pad 26 is configured to abut the support 23 at a part of the long width of the nip formation pad 26, another part not abutting the support 23 may not receive pressure from the pressing roller 31 precisely, decreasing pressure exerted between the pressing roller 31 and the fixing belt 21 at the fixing nip N and resulting in formation of a faulty toner image T. To address this circumstance, according to this exemplary embodiment, the abutment face 26*c* of the nip formation pad 26 abuts the support 23 throughout the entire width of the abutment face 26*c* in the longitudinal direction of the nip formation pad 26 that is greater than at least the width of the maximum size recording medium P available in the image forming apparatus 1.

As the pressing roller 31 rotates in the rotation direction R4, the nip formation pad 26 receives friction from the pressing roller 31 through the fixing belt 21. However, the support 23 mounted on and supported by the side plates 43 abuts the abutment face 26*c* of the nip formation pad 26 throughout the entire width of the nip formation pad 26 in the longitudinal direction thereof to support the nip formation pad 26, thus preventing the nip formation pad 26 from being deformed by friction from the pressing roller 31.

As described above, the heat conductor 22 is manufactured by bending a metal plate (e.g., a stainless steel plate) into a substantial pipe or tube. The thin heat conductor 22 is heated by the heater 25 quickly, shortening the warm-up time of the fixing device 20. However, since the thin heat conductor 22 has a decreased rigidity, as it receives pressure from the pressing roller 31, it may not resist the pressure and may be deformed or bent. If the heat conductor 22 is deformed or bent, the fixing nip N may not have a desired length in the recording medium conveyance direction Y10, degrading fixing quality to fix the toner image T on the recording medium P. To address this circumstance, as shown in FIG. 8, a predetermined clearance is secured between the opening 22*a* of the heat conductor 22 and the nip formation pad 26. Accordingly, the heat conductor 22 does not receive pressure from the pressing roller 31 and therefore is not deformed or bent by pressure from the pressing roller 31.

With reference to FIGS. 1 and 2, a description is provided of a fixing operation of the fixing device 20 having the configuration described above to fix a toner image T on a recording medium P.

As a power switch of the image forming apparatus 1 is turned on, a power supply supplies power to the heater 25. Simultaneously, the pressing roller 31 rotates in the rotation direction R4. Accordingly, the fixing belt 21 rotates in the rotation direction R3 in accordance with rotation of the pressing roller 31 by friction therebetween at the fixing nip N. Thereafter, as a recording medium P conveyed from the paper tray 12 reaches the secondary transfer nip, the secondary transfer roller 89 secondarily transfers a toner image T formed on the intermediate transfer belt 78 onto the recording medium P.

The recording medium P bearing the toner image T is conveyed in the recording medium conveyance direction Y10 while guided by a guide plate and enters the fixing nip N formed between the fixing belt 21 and the pressing roller 31 pressed against the fixing belt 21. As the recording medium P is conveyed through the fixing nip N, the recording medium P receives heat from the fixing belt 21 heated by the heater 25 through the heat conductor 22 and pressure from the pressing roller 31 and the fixing belt 21 pressed against the pressing roller 31 by the nip formation pad 26 supported by the support 23. Thus, the toner image T is fixed on the recording medium P by the heat and pressure. Thereafter, the recording medium P bearing the fixed toner image T is discharged from the fixing nip N and conveyed in a recording medium conveyance direction Y11.

Figure 9:
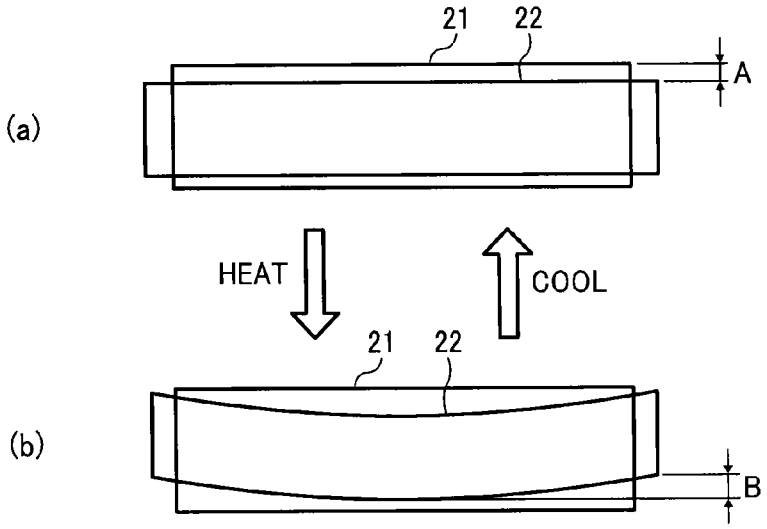
FIG. 9 is a schematic side view of the fixing belt and the heat conductor incorporated in the fixing device shown in FIG. 4.

With reference to FIG. 9, a description is provided of thermal deformation of the heat conductor 22.

FIG. 9 is a schematic side view of the fixing belt 21 and the heat conductor 22. Diagram (a) of FIG. 9 illustrates the fixing belt 21 and the heat conductor 22 at ambient temperature. As the heat conductor 22 is heated by the heater 25 depicted in FIG. 2, the heat conductor 22 is thermally deformed and bent as shown in diagram (b) of FIG. 9, producing a bending B in a diametrical direction of the heat conductor 22. The clearance A created between the fixing belt 21 and the heat conductor 22 at ambient temperature decreases as the bending B of the heat conductor 22 increases. Under a condition in which the heat conductor 22 is heated and cooled and vice versa, when the heat conductor 22 is cooled to ambient temperature, the clearance A is retrieved as shown in diagram (a) of FIG. 9.

A detailed description is now given of change in the bending B of the heat conductor 22 as the heat conductor 22 is heated from ambient temperature.

During warm-up of the fixing device 20, the heat conductor 22 at ambient temperature or a temperature close to ambient temperature is heated by the heater 25 relatively quickly to a target fixing temperature of the fixing belt 21 at which the toner image T is fixed on the recording medium P. Immediately after the heater 25 starts heating the heat conductor 22, an outer circumferential surface of the heat conductor 22 that is situated farther from the heater 25 than an inner circumferential surface of the heat conductor 22 has a temperature lower than a temperature of the inner circumferential surface of the heat conductor 22. Further, the relatively sharp temperature gradient is created in the diametrical direction of the heat conductor 22. Thus, the temperature distribution of the heat conductor 22 is uneven throughout the entire heat conductor 22. Accordingly, thermal expansion of the heat conductor 22 varies partially, bending the heat conductor 22 by thermal deformation. The maximum bending of the heat conductor 22 is defined as a maximum bending Bmax.

As the fixing device 20 is ready to fix the toner image T on the recording medium P and the temperature of the fixing belt 21 is maintained at or near the target fixing temperature, the temperature of the heat conductor 22 is even throughout the entire heat conductor 22 with a decreased temperature gradient in the diametrical direction of the heat conductor 22. Accordingly, the bending B of the heat conductor 22 decreases compared to that immediately after the heater 25 starts heating the heat conductor 22. Thus, a stable bending Bave of the heat conductor 22 is retained.

The clearance A between the fixing belt 21 and the heat conductor 22 is defined by a formula (1) below.

$$B\max \geq A > B\text{ave} \quad (1)$$

The inner diameter of the fixing belt 21, the outer diameter of the heat conductor 22, the material, thickness, and type of the heat conductor 22, and fixing conditions of the fixing device 20 such as the target fixing temperature are determined to satisfy the formula (1).

According to this exemplary embodiment, the inner diameter of the fixing belt 21 is about 30 mm; the outer diameter of the heat conductor 22 is about 29.5 mm. Hence, the clearance A is about 0.5 mm. However, the clearance A is not limited to the above. The heat conductor 22 is made of SUS 430 stainless steel having a thickness of about 0.1 mm and heated by the heater 25. The target fixing temperature is about 180 degrees centigrade. However, the configuration of the heat conductor 22 is not limited to the above. Accordingly, the maximum bending Bmax of the heat conductor 22 is about 1.3 mm. The stable bending Bave of the heat conductor 22 is about 0.4 mm. Thus, the clearance A, the maximum bending Bmax, and the stable bending Bave satisfy the formula (1). However, the maximum Bmax and the stable bending Bave of the heat conductor 22 are not limited to the above.

Since the maximum bending Bmax of the heat conductor 22 is not smaller than the clearance A, during warm-up of the fixing device 20 while the fixing belt 21 halts, the inner circumferential surface 21*a* of the fixing belt 21 comes into contact with the heat conductor 22 precisely. That is, an air layer is not interposed between the heat conductor 22 and the fixing belt 21 and thus heat is conducted from the heat conductor 22 to the fixing belt 21 effectively, improving heating efficiency of the heat conductor 22 to heat the fixing belt 21.

Since the stable bending Bave of the heat conductor 22 is smaller than the clearance A, during fixing, the inner circumferential surface 21*a* of the fixing belt 21 is disposed opposite the heat conductor 22 with a slight clearance therebetween. Even if the fixing belt 21 comes into contact with the heat conductor 22, it contacts the heat conductor 22 with slight pressure therebetween. Accordingly, the heat conductor 22 heats the fixing belt 21 effectively while reducing abrasion of the fixing belt 21 and the heat conductor 22.

Figure 10:
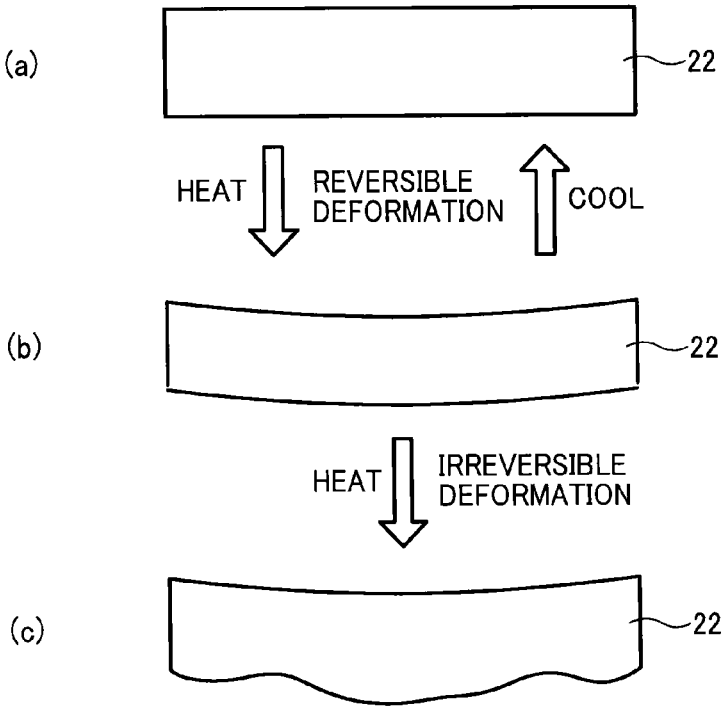
FIG. 10 is a schematic side view of the heat conductor shown in FIG. 9.

With reference to FIG. 10, a description is provided of thermal deformation of the heat conductor 22.

FIG. 10 is a schematic side view of the heat conductor 22. The straight heat conductor 22 shown in diagram (a) of FIG. 10, as it is heated by the heater 25, is bent by thermal deformation as shown in diagram (b) of FIG. 10. As the heat conductor 22 is cooled to ambient temperature, the bent heat conductor 22 is subject to reversible deformation and recovers its original straight shape. However, as the heat conductor 22 is heated in an increased amount, the bent heat conductor 22 is subject to irreversible deformation and does not recover its original straight shape.

When the bent heat conductor 22 is subject to irreversible deformation and does not recover its original shape even at ambient temperature, the heat conductor 22 is crimped by plastic deformation. Once the heat conductor 22 is crimped by plastic deformation, as the recording medium P is conveyed through the fixing nip N, a part of the heat conductor 22 may come into contact with the inner circumferential surface 21*a* of the fixing belt 21 with increased pressure therebetween. Accordingly, the heat conductor 22 may scratch the inner circumferential surface 21*a* of the heat conductor 22 or cause variation in the temperature of the fixing belt 21, resulting faulty fixing or variation in gloss of the toner image T on the recording medium P.

Crimping of the heat conductor 22 is prevented by optimizing the hardness of the heat conductor 22. Generally, if the hardness of the heat conductor 22 is excessively great, the heat conductor 22 does not recover from thermal deformation and therefore is crimped. Conversely, if the hardness of the heat conductor 22 is relatively small, even if the heat conductor 22 is thermally deformed, it is flexible enough to recover from thermal deformation to its original shape. That is, the heat conductor 22 having the relatively small hardness is susceptible to reversible thermal deformation.

Figure 11:
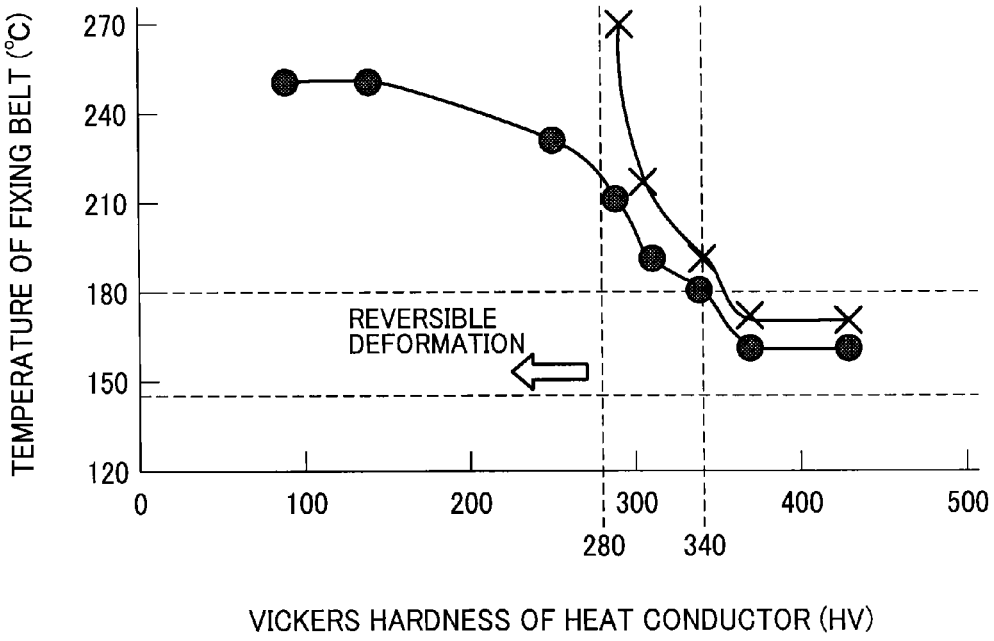
FIG. 11 is a graph showing a relation between the Vickers hardness of the heat conductor shown in FIG. 10 and the temperature of the fixing belt shown in FIG. 9 at which the heat conductor is crimped.

With reference to FIG. 11, a description is provided of an experiment for examining occurrence of crimping of the heat conductor 22.

FIG. 11 is a graph showing a relation between the Vickers hardness of the heat conductor 22 and the temperature of the fixing belt 21 at which the heat conductor 22 is crimped. A plurality of experimental pieces is prepared by adhering a fixing belt to a surface of a plurality of metal heat conductors having various Vickers hardnesses. The metal heat conductors have a thickness of 0.1 mm. The fixing belt is constructed of a nickel layer contacting the metal heat conductor and having a thickness of 35 micrometers; a silicone rubber layer coating the nickel layer and having a thickness of 200 micrometers; and a PFA layer coating the silicone rubber layer and having a thickness of 15 micrometers. As the metal heat conductor is heated to a predetermined temperature quickly, whether or not the metal heat conductor is crimped is examined as shown in FIG. 11.

In FIG. 11, the horizontal axis represents the Vickers hardness of the metal heat conductor. The vertical axis represents the surface temperature of the fixing belt, that is, the temperature of the PFA layer of the fixing belt. "●" indicates no crimping of the metal heat conductor. Conversely, "x" indicates crimping of the metal heat conductor. For example, as shown in FIG. 11, the metal heat conductor having a Vickers hardness of about 300 HV, as the fixing belt is heated to about 190 degrees centigrade quickly, is not crimped. Conversely, the metal heat conductor having a Vickers hardness of about 300 HV, as the fixing belt is heated to about 210 degrees centigrade quickly, is crimped. The metal heat conductor having a Vickers hardness not greater than about 280 HV, regardless of the target fixing temperature, is not crimped. Even the metal heat conductor having a Vickers hardness not greater than about 340 HV, if the target fixing temperature is not greater than 180 degrees centigrade, is not crimped.

According to this exemplary embodiment, the metal heat conductor 22 has a thickness not greater than about 0.1 mm and a Vickers hardness not greater than about 280 HV. However, the thickness and the Vickers hardness of the heat conductor 22 are not limited to the above.

The heat conductor 22 is made of ferrite stainless steel such as SUS 430 stainless steel having a relatively small heat capacity ratio per unit volume. For example, SUS 430 stainless steel has a density of $7.73\times10^{-3}$ kg/m$^3$, a specific heat of 0.46 kJ/kg° C., a Young's modulus of 206 Gpa, a Vickers hardness of 250 HV, and a heat capacity ratio per unit volume of 3.56. However, property of stainless steel SUS 430 of the heat conductor 22 is not limited to the above. Accordingly, the heat conductor 22 is heated effectively and is not crimped.

Nickel has a density of $8.9\times10^{-3}$ kg/m$^3$, a specific heat of 0.439 kJ/kg° C., a Young's modulus of 210 Gpa, a Vickers hardness of 96 HV, and a heat capacity ratio per unit volume of 3.91.

SUS 304—½H stainless steel has a density of $7.93\times10^{-3}$ kg/m$^3$, a specific heat of 0.502 kJ/kg° C., a Young's modulus of 197 Gpa, a Vickers hardness of 250 HV, and a heat capacity ratio per unit volume of 3.98.

During warm-up of the fixing belt 21, the heat conductor 22 disposed opposite the inner circumferential surface 21*a* of the fixing belt 21 deforms in the maximum bending Bmax. While the recording medium P is conveyed through the fixing nip N, the heat conductor 22 retains the relatively small, stable bending Bave. Utilizing such deformation of the heat conductor 22, the clearance A between the fixing belt 21 and the heat conductor 22 is optimized. Accordingly, even if the fixing device 20 is configured to be warmed up quickly, achieve a shortened first print time taken to output the recording medium P bearing the fixed toner image T after receiving a print job, and convey the recording medium P at high speed, the heat conductor 22 heats the fixing belt 21 efficiently, fixing the toner image T on the recording medium P precisely. Further, the fixing belt 21 does not come into contact with the heat conductor 22 as it rotates in the rotation direction R3, reducing abrasion of the fixing belt 21 by friction between the fixing belt 21 and the heat conductor 22.

As shown in FIG. 2, the fixing device 20 includes the fixing belt 21 serving as a flexible endless belt formed into a loop and rotatable in the rotation direction R3 and the nip formation pad 26 disposed opposite the inner circumferential surface 21*a* of the fixing belt 21 and pressing against the pressing roller 31 via the fixing belt 21 to form the fixing nip N between the fixing belt 21 and the pressing roller 31 through which a recording medium P bearing a toner image T is conveyed.

The heat conductor 22 is disposed opposite the inner circumferential surface 21*a* of the fixing belt 21 to heat the fixing belt 21. The heater 25 is disposed opposite the inner circumferential surface of the heat conductor 22 to heat the heat conductor 22. As the pressing roller 31 is pressed against the nip formation pad 26 via the fixing belt 21, the support 23, disposed opposite the inner circumferential surface of the heat conductor 22 and contacting the abutment face 26*c* of the nip formation pad 26, supports the nip formation pad 26. The heat insulator 27 is interposed between the heater 25 and the nip formation pad 26 and the support 23 to shield the nip formation pad 26 and the support 23 from the heater 25. The heat insulator 27 is made of a single component. Thus, the heat insulator 27 prohibits the heater 25 from heating the nonmetallic nip formation pad 26 directly, preventing degradation in durability of the nip formation pad 26 by heat radiated from the heater 25.

Since the heat insulator 27 is made of a single component, the heat insulator 27 is assembled with a reduced number of processes. Further, the heat insulator 27 has a decreased heat capacity that shortens the warm-up time to heat the fixing belt 21 to the desired fixing temperature and saves energy.

The heater 25 is an infrared heater. Hence, the heater 25 is versatile, simple, and manufactured at low-cost.

The heat insulator 27 includes an infrared reflection plate to reflect light, that is, heat, radiated from the heater 25. The heat insulator 27 is made of high intensity aluminum having an infrared reflectance not smaller than about 90 percent. Accordingly, the heat insulator 27 reflects light emitted from the heater 25 toward the support 23 and the nip formation pad 26 to the heat conductor 22, heating the heat conductor 22 and therefore improving heating efficiency of the heat conductor 22 to heat the fixing belt 21. Consequently, the heat insulator 27 shortens the warm-up time to warm up the fixing belt 21, saving energy.

The heat insulator 27 mounted on and supported by the support 23 insulates the nip formation pad 26 from heat radiated from the heater 25 toward the nip formation pad 26. The nip formation pad 26 is made of heat resistant resin. Accordingly, the heat insulator 27 insulates the nip formation pad 26 from heat radiated from the heater 25 toward the nip formation pad 26, preventing degradation in durability of the nip formation pad 26 made of nonmetallic, heat resistant resin.

The base layer 21*b* of the fixing belt 21 is made of heat resistant resin. As shown in FIG. 2, the opening 22*a* of the heat conductor 22 is disposed opposite the pressing roller 31 via the nip formation pad 26 and the fixing belt 21. The heat conductor 22 having a decreased heat capacity and retaining a predetermined shape is disposed opposite the inner circumferential surface 21*a* of the fixing belt 21. Accordingly, the heat conductor 22 prohibits the heater 25 from heating the fixing belt 21 directly. Further, the heat conductor 22 heated by the heater 25 heats the entire fixing belt 21 evenly and effectively.

Since the fixing belt 21 is not heated by the heater 25 directly, the base layer 21*b* of the fixing belt 21 is made of low-cost, heat resistant resin. Hence, the fixing belt 21 is manufactured at reduced costs.

A description is provided of variations of the components incorporated in the fixing device 20.

According to the exemplary embodiments described above, the heat insulator 27 is bent and curved as shown in FIG. 5 such that the curved, third reflection face 27*c* bridges the first reflection face 27*a* and the second reflection face 27*b*. Alternatively, the heat insulator 27 may not include the curved, third reflection face 27*c* and therefore the first reflection face 27*a* may be coupled with the second reflection face 27*b* as shown in FIG. 12.

Figure 12:
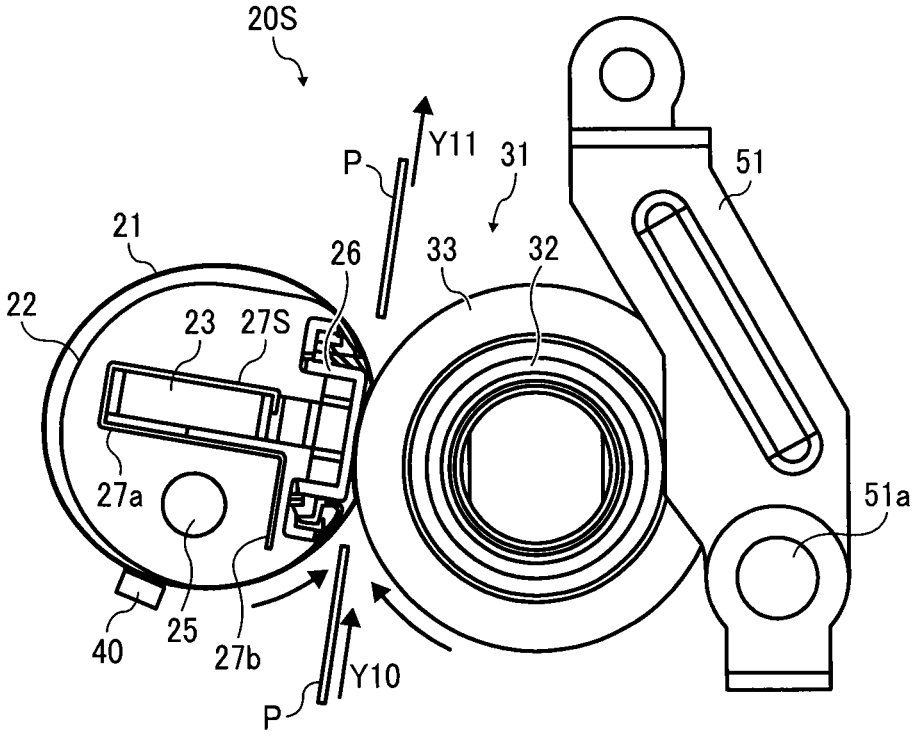
FIG. 12 is a vertical sectional view of a fixing device incorporating a heat insulator as a variation of the heat insulator shown in FIG. 5.

FIG. 12 is a vertical sectional view of a fixing device 20S. As shown in FIG. 12, the fixing device 20S includes a heat insulator 27S constructed of the first reflection face 27*a* and the second reflection face 27*b* coupled with the first reflection face 27*a*. The first reflection face 27*a* adjoins the second reflection face 27*b* at a right angle.

Yet alternatively, instead of the curved, third reflection face 27*c* shown in FIG. 5, a planar face may bridge the first reflection face 27*a* and the second reflection face 27*b*. Accordingly, the heat insulator 27 is manufactured by pressing, reducing manufacturing costs.

According to the exemplary embodiments described above, the heat insulator 27 is made of a material having an increased surface reflectance. Alternatively, a surface of the heat insulator 27 may be coated with a material having an increased reflectance or treated with vacuum deposition to improve surface reflectance.

According to the exemplary embodiments described above, the heat insulator 27 is mounted on the support 23. Alternatively, the heat insulator 27 may be mounted on and supported by the side plates 43 of the fixing device 20.

As shown in FIG. 2, the opposed face 26*d* of the nip formation pad 26 disposed opposite the pressing roller 31 at the fixing nip N is concave with respect to the pressing roller 31 in cross-section. Alternatively, the opposed face 26*d* of the nip formation pad 26 may be planar. Accordingly, the nip formation pad 26 prevents the recording medium P conveyed through the fixing nip N from creasing. Additionally, the nip formation pad 26 increases the curvature of the fixing belt 21 at an exit of the fixing nip N, facilitating separation of the recording medium P discharged from the fixing nip N from the fixing belt 21.

According to the exemplary embodiments described above, a lubricant, such as fluorine grease, is applied between the heat conductor 22 and the fixing belt 21 sliding thereover to reduce frictional resistance therebetween. Alternatively, the outer circumferential surface of the heat conductor 22 that contacts the fixing belt 21 may be made of a material having a decreased friction coefficient. Yet alternatively, the inner circumferential surface 21*a* of the fixing belt 21 may be made of fluoroplastic.

According to the exemplary embodiments described above, the heat conductor 22 is substantially circular in cross-section. Alternatively, the heat conductor 22 may be polygonal in cross-section.

As shown in FIG. 2, no heater is situated inside the pressing roller 31. Alternatively, a heater such as a halogen heater may be situated inside the pressing roller 31.

According to the exemplary embodiments described above, the loop diameter of the fixing belt 21 is equivalent to the diameter of the pressing roller 31. Alternatively, the loop diameter of the fixing belt 21 may be smaller than the diameter of the pressing roller 31. In this case, the curvature of the fixing belt 21 at the fixing nip N is greater than that of the pressing roller 31, facilitating separation of the recording medium P discharged from the fixing nip N from the fixing belt 21. Alternatively, the loop diameter of the fixing belt 21 may be greater than the diameter of the pressing roller 31. According to the exemplary embodiments described above, regardless of a relation between the loop diameter of the fixing belt 21 and the diameter of the pressing roller 31, the heat conductor 22 does not receive pressure from the pressing roller 31.

With reference to FIGS. 2 and 8, a description is provided of advantages of the fixing device 20.

The fixing device 20 includes a flexible endless belt (e.g., the fixing belt 21) formed into a loop and rotatable in the rotation direction R3; a pressing rotary body (e.g., the pressing roller 31) disposed opposite the endless belt; and the nip formation pad 26 disposed opposite the inner circumferential surface 21*a* of the endless belt and pressing the endless belt against the pressing rotary body to form the fixing nip N between the endless belt and the pressing rotary body through which a recording medium P bearing a toner image T is conveyed. The heat conductor 22 is disposed opposite the inner circumferential surface 21*a* of the endless belt to heat the endless belt. The heater 25 is disposed opposite the inner circumferential surface of the heat conductor 22 to heat the heat conductor 22. The support 23 is disposed opposite the inner circumferential surface of the heat conductor 22. As the pressing rotary body is pressed against the nip formation pad 26 via the endless belt, the support 23 contacting the abutment face 26*c* of the nip formation pad 26 supports the nip formation pad 26 against pressure from the pressing rotary body. The heat insulator 27 is interposed between the heater 25 and the nip formation pad 26 and the support 23 to shield the nip formation pad 26 and the support 23 from the heater 25. The heat insulator 27 is constructed of a single component.

The fixing device 20 incorporating the heat insulator 27 reduces the number of the components incorporated therein and the number of assembly processes, thus shortening the warm-up time to warm up the endless belt and saving energy. Additionally, the heat insulator 27 prevents degradation in durability of the nip formation pad 26.

According to the exemplary embodiments described above, the pressing roller 31 is used as a pressing rotary body. Alternatively, a pressing belt or the like may be used as a pressing rotary body. Further, the fixing belt 21 is used as an endless belt. As used herein, the term "endless belt" is not to be limited to a belt as commonly known but is to be understood to include an endless film and the like.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a flexible endless belt rotatable in a predetermined direction of rotation;

a heater disposed opposite an inner circumferential surface of the endless belt to heat the endless belt;

a pressing rotary body disposed opposite the endless belt;

a nip formation pad disposed opposite the inner circumferential surface of the endless belt and pressing the endless belt against the pressing rotary body to form a fixing nip between the endless belt and the pressing rotary body through which a recording medium bearing a toner image is conveyed;

a support contacting the nip formation pad to support the nip formation pad against pressure from the pressing rotary body; and a heat insulator, interposed between the heater and the nip formation pad and the support, to at least partially surround opposing sides of the support, the heat insulator including a first reflection face and a second reflection face that are disposed opposite the heater.

2. The fixing device according to claim 1, wherein the heat insulator further includes a curved third reflection face bridging the first reflection face and the second reflection face and disposed opposite the heater.

3. The fixing device according to claim 1, wherein the heat insulator is constructed of a single component.

4. The fixing device according to claim 1, wherein the heat insulator is coated with a material having an increased reflectance.

5. The fixing device according to claim 1, wherein the heater is disposed upstream from the support and the fixing nip in the direction of rotation of the endless belt.

6. The fixing device according to claim 1, wherein the first reflection face adjoins the second reflection face at a right angle.

7. The fixing device according to claim 1, wherein the first reflection face of the heat insulator is disposed opposite the support, and wherein a space is provided between the support and the first reflection face of the heat insulator.

8. An image forming apparatus comprising the fixing device according to claim 1.

* * * * *